US005630459A

United States Patent [19]

Martin

[11] Patent Number: 5,630,459

[45] Date of Patent: May 20, 1997

[54] SHIELD APPARATUS AND METHOD FOR SECTIONAL DOOR HINGE

[75] Inventor: David O. Martin, Salt Lake City, Utah

[73] Assignee: Martin Door Manufacturing, Inc., Salt Lake City, Utah

[21] Appl. No.: 401,562

[22] Filed: Mar. 9, 1995

[51] Int. Cl.[6] ..... E06B 3/12; E06B 9/00

[52] U.S. Cl. ..... 160/236; 160/229.1; 160/201

[58] Field of Search ..... 160/229.1, 201, 160/236; 312/297

[56] References Cited

U.S. PATENT DOCUMENTS

| | | | |
|---|---|---|---|
| 1,626,844 | 10/1927 | Kuhn | 160/229.1 |
| 3,608,613 | 9/1971 | Halliwell | 160/201 |
| 3,648,755 | 3/1972 | Thiele | 160/229.1 |
| 4,269,253 | 5/1981 | Ziegler | 160/229.1 |

*Primary Examiner*—Brian K. Green
*Assistant Examiner*—Curtis A. Cohen
*Attorney, Agent, or Firm*—J. Winslow Young

[57] ABSTRACT

A shield apparatus and method for guarding the gap between door sections of a sectional door to inhibit the insertion of fingers into the gap as the sectional door traverses between the elevated open position to the lowered, closed position. The shield apparatus is configured as an outer shield and an inner shield, both of which are fabricated from a resilient sheet material. The outer shield is formed into an L-shaped cross section along its length with the foot portion of the L shape being mounted to the upper edge of the lower door section so that the leg portion of the L shape extends upwardly across the gap between the lower door section and the upper door section. A water diversion channel is formed into the foot to divert water to the ends of the sectional door to preclude the water from dripping from the sectional door as it is raised to the open, overhead position. A pair of double-face tapes are used to secure the shield apparatus to the top edge of the lower door section. The inner shield is configured as a strip of resilient material such as plastic that is mounted to the lower edge of the inner face of the upper door section so that it extends downwardly across the gap between these two door sections. The resiliency of the inner shield causes the inner shield to slidingly cooperate with the inner face of the upper edge of the lower door section as the sectional door closes.

5 Claims, 4 Drawing Sheets

SHIELD APPARATUS AND METHOD FOR SECTIONAL DOOR HINGE

BACKGROUND

1. Field of the Invention

This invention relates to sectional doors and, more particularly to a novel hinge shield apparatus and method for shielding the gap between adjacent door sections of a sectional door to preclude the inadvertent placement of fingers into the gap, the gap being formed as the door sections sequentially traverse the curved track between the open and the closed positions.

2. The Prior Art

Sectional doors, also commonly referred to as overhead garage doors or, simply, overhead doors, are well known throughout the world. These particular doors are designated by these names by reason of their design/operation as well as their usage. In particular, sectional doors are designed to provide closure for a large opening such as the ingress/egress to an automotive garage. In order to accommodate closure of such a large opening, the sectional door is assembled from a plurality of door sections. These door sections have a length which spans the opening and are hingedly joined edge to edge to create the door, hence the name, sectional door. The hinged relationship between adjacent sections allows the sectional door to traverse a curved track between the vertical, closed position to the overhead, open position, hence the alternate name, overhead door. The sectional door is moved between the vertical, closed orientation and the overhead, open configuration with the orientation thereof being controlled by the supportive tracks. Sectional doors are quite heavy so that various systems have been devised to not only compensate for this weight but to move the sectional door along its supportive tracks between the open and closed positions. Customarily, coil springs under tension provide the necessary weight compensatory force while an electric motor provides the motive force.

A planar overall surface to the sectional door is obtained by having the abutting edges of the door sections configured with an interlocking tongue and groove relationship. The tongue portion is located on the upper edge of the lower door section while the groove portion is located on the abutting, lower edge of the upper door section. This particular orientation of the tongue and groove relationship is used throughout the sectional door industry in order not only to provide a more uniform or planar appearance to the closed sectional door but also to reduce the amount of water that would otherwise collect in the groove portion if the tongue and groove relationship were reversed. As it is, a significant amount of water from precipitation, adjacent sprinklers, and the like, collects in the space between the adjacent door sections so that when the sectional door is raised this water drips inside the garage.

As the sectional door moves between the two positions, open and closed, each door section sequentially traverses the curved track between these two positions. During this traverse a relatively large gap is created between each succeeding section as each section changes direction from the vertical to the horizontal orientation and vice versa. It is during the transition from the upper, horizontal, open position to the lower, vertical, closed position that this gap becomes significant in that it gapes open significantly as the lower door section turns to the vertical orientation while the next succeeding door section continues its transition from the horizontal to the vertical orientation. This gap results from the fact that the sectional door is relatively thick and the hinge line between adjacent door sections is mounted on the inner face of the sectional door so that the change in orientation for each planar, door section from the horizontal to the vertical will create a gap between it and the following door section. As can be seen, this gap is relatively large but rapidly disappears as the two door sections assume the vertical orientation. The relatively wide spacing of this gap coupled with its relatively rapid rate of closure has resulted in serious injury to persons who either deliberately or inadvertently place their fingers in the closing gap. Deliberate placement of fingers occurs when the person attempts to hasten the closure of the door while inadvertent placement occurs when the person simply is not paying attention. In both instances the results can be quite serious including amputation of the affected fingertips.

Interiorly a gap is also created by the fact that the hinge line between adjacent door sections is spaced outwardly from the interior surface of the sectional door. This outward spacing creates an interior gap that can also represent a hazard to the homeowner. In one particular instance, a homeowner was in the process of closing a sectional door that had broken one of its support springs. A power failure had also rendered the lift motor inoperative. When he released the sectional door from the lift motor to move the door toward closure, the first door section under the force of gravity rapidly pulled the rest of the door down. The homeowner was inside the garage and instinctively reached out to retard the fall of the sectional door and inadvertently inserted three fingers of one hand into the gap between two adjacent door sections. The rapidly closing sectional door imposed an excruciating pain on the trapped fingers such that the person jerked his hand free. Unfortunately, the powerful crushing action by the closing gap coupled with the forceful jerk of the hand resulted in the complete severance of one portion of one finger and the tearing of a substantial portion of the flesh from the other two fingers.

Even though tragedies of a similar nature have occurred all too frequently there are no known systems that effectively shield the gaps in a sectional door as it is being moved downwardly to the closed position. One company has created a modified edge system for its sectional doors by changing the abutting edges of the door sections from a traverse tongue and groove relationship to a slanted edge relationship. This feature removes the ninety degree corner and replaces it with a slanted surface so that grasping the upper edge of the downwardly moving door section is not feasible. Further, the bottom edge of the following door section is designed to push away any fingers that may have been placed therein. However, such a sectional door has a distinct disadvantage in that when it is oriented vertically in the closed position each door section rests upon the next section below. The heavy weight of the sectional door and the angled or slanted surface between adjacent door sections forces the door sections out of their planar alignment rendering a somewhat shiplap-type appearance to the sectional door.

In view of the foregoing it would be a significant advancement in the art to provide a shield apparatus and method for shielding the gap between door sections particularly during movement of the sectional door to its closed position. It would be an even further advancement in the art to provide a shield apparatus that can be protectively shipped in releasable attachment to a lower edge of an upper door section and then securely mounted to the upper edge of a lower door section. Another advancement in the art would be to provide a shield apparatus that also prevents water leakage inside the garage as the sectional door is raised to its open position. It would also be an advancement in the art to provide a shield/water channel apparatus that retains at least a portion of the tongue and groove relationship between adjacent door sections for alignment purposes. Such a novel shield apparatus and method for shielding the gap between door sections of a sectional door are disclosed and claimed herein.

BRIEF SUMMARY AND OBJECTS OF THE INVENTION

This invention involves a shield apparatus and method for shielding the gap that appears between two adjacent, hinged door sections of a sectional door as the door makes its transition from the open, upper, horizontal position to the closed, lowered, vertical position. The shield is configured as an elongated strip of resilient sheet material having a length corresponding to the length of the door sections. The strip is formed longitudinally with a generally L-shaped cross section. The foot portion of the L-shape is configured to nest against the upper edge of the lower door section while the leg portion of the L-shape extends upwardly across the gap between the two sections to shield the gap against the inadvertent or even deliberate intrusion of one or more fingers into the gap. The foot section includes a water diversion channel for diverting collected water outwardly toward the ends of the sectional door. The shield apparatus is shipped with a door section by being releasably mounted to the bottom edge of the upper door section with the leg portion releasably secured against the surface of the door section. Upon assembly of the door section into a sectional door, the leg portion is released after the foot portion is secured to the abutting, upper edge of the lower door section.

It is, therefore, a primary object of this invention to provide improvements in apparatus for shielding the gap between adjacent sections of a sectional door.

Another object of this invention is to provide improvements in the method for shielding the gap between adjacent door sections of a sectional door.

Another object of this invention is to provide a shield apparatus for shielding the gap between door sections of a sectional door.

Another object of this invention is to provide a shield configured as a strip of resilient sheet material having a length corresponding to the width of the sectional door and formed with an L-shaped cross section with the foot portion residing between the two adjacent door sections and the leg portion extending across the gap between the two sections.

Another object of this invention is to provide a water diversion channel in the foot portion to drain away water therein when the leg portion is oriented upwardly.

Another object of this invention is to provide a planar shield of resilient sheet material for resiliently shielding the gap between adjacent door sections on the inner face of the sectional door.

These and other objects and features of the present invention will become more readily apparent from the following description in which preferred and other embodiments of the invention have been set forth in conjunction with the accompanying drawing and appended claims.

DETAILED DESCRIPTION OF THE PREFERRED EMBODIMENT

Figure 1:
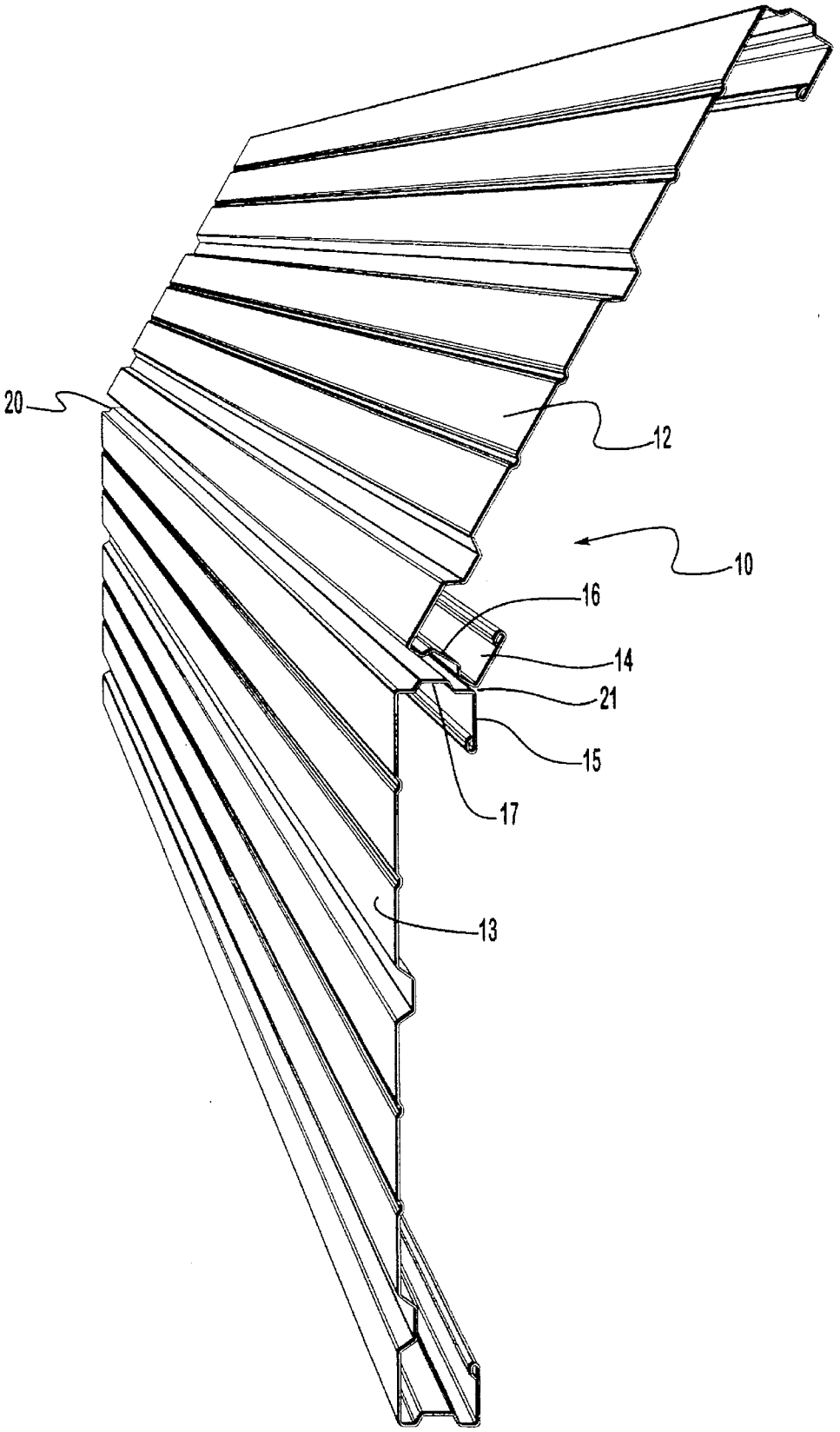
FIG. 1 (PRIOR ART)
FIG. 1 (Prior Art) is a perspective view of a portion of a prior art sectional door during its transition between the open and closed positions showing the gap formed between the two door sections.

The invention is best understood by reference to the drawing wherein like parts are designated by like numerals throughout in conjunction with the following description.

Discussion of FIG. 1 (Prior Art)

Referring now to FIG. 1 (Prior Art) a portion of one commonly used sectional door is shown generally at 10 and includes an upper door section 12 and a lower door section 13. Upper door section 12 includes a bottom edge 14 having a groove 16 formed in the bottom face thereof. Correspondingly, lower door section 13, includes a top edge 15 having a tongue 17 formed therein. The profile of groove 16 is designed to receive tongue 17 therein in a conventional tongue and groove relationship.

Upper door section 12 is hingedly joined to lower door section 13 by a plurality of hinges (not shown) mounted in a spaced relationship across the interior portions of bottom edge 14 and top edge 15. These hinges join upper door section 12 to lower door section 13 as part of the overall construction of sectional door 10, the remaining door sections not being shown for purposes of clarity.

As illustrated, lower door section 13 is shown in the vertical, closed orientation for sectional door 10 while upper door section 12 is shown toward the end of in its transitional movement downwardly across the curved portion of the support tracks (not shown) which movement changes sectional door 10 between its open and closed positions. Importantly, this movement of sectional door 10 creates an exterior gap 20 and an interior gap 21 between upper door section 12 and lower door section 13. Accordingly, when sectional door 10 is in transition between its open, overhead position to its closed, vertical position (as represented by the orientation of lower door section 13) exterior gap 20 and interior gap 21 are created as upper door section 12 is rotated 90° as it passes from the upper or overhead and horizontal orientation to the vertical position represented by lower door section 13. Exterior gap 20 and interior gap 21 are each created as sectional door 10 travels downwardly. Specifically, exterior gap 20 and interior gap 21 are created just as upper door section 12 is rotated and bottom edge 14 begins its downward traverse. Importantly, each of these gaps rapidly closes as upper door section 12 continues its downward traverse and becomes oriented vertically and parallel with lower door section 13.

Exterior gap 20 opens between about 3 cm and 6 cm while interior gap will open to about 1 cm to 3 cm. Since the track curvature occurs overhead it means that both exterior gap 20 and interior gap 21 are created overhead and, on most commonly found residential garage doors, occur within easy reach of the outstretched hand of the average person.

Regrettably, it is almost instinctive for a person to place his/her fingers in either of exterior gap 20 or interior gap 21 and pull thereon to assist sectional door 10 in its downward movement. The width of exterior gap 20 and interior gap 21 along with their overhead location make them the logical place for the placement of fingers for the exertion of a downward pulling force on sectional door 10. However, the rapidity with which exterior gap 20 and interior gap 21 closes is quite surprising since this rapid closure occurs over a distance of only a few centimeters as sectional door 10 moves downwardly. This rapid closure of exterior gap 20 and interior gap 21 means that any fingers inserted in either of these gaps will most likely be pinched if not severally crushed. Numerous instances are known wherein such severe injuries have occurred.

General Discussion of the Invention

The novel shield apparatus and method of this invention provides a sectional door with a safe, aesthetically pleasing shield system for preventing fingers from being pinched in the hinge opening between the sections of the sectional door as it is being moved to the closed position. The exterior shield is fabricated from a resilient sheet material and configured with a modified L-shaped cross section. The foot or transverse portion of the L-shaped shield is secured to the top edge of the lower door section so as to support the vertical leg of the L-shaped shield as a shield across the gap that opens and closes as the adjacent sections of the sectional door move downwardly. The exterior face of the shield blends with the color and surface texture of the sectional door to provide the aesthetically pleasing appearance. The length of the vertical leg is coordinated with the pattern of the corresponding edge of the underlying door section so as to have the edge portion of the vertical leg blend into the pattern.

Interiorly, a strip of resilient plastic is secured along its upper edge to the innerface of the bottom edge of the upper door section. The free edge of the plastic strip rests against the inner face of the top edge of the lower door section so that it slidingly shields the inner gap between door sections of the sectional door as the sectional door is lowered.

Uniquely, the L-shaped shield is releasably fastened against the bottom edge of the upper door section during shipment of the door sections. This method of shipment protects the L-shaped shield against damage while simultaneously providing for the simple installation of the L-shaped shield once the door sections have been assembled into the sectional door. Specifically, both the bottom of the foot of the L-shaped shield and the top edge of the lower door section carry a strip of double-face adhesive tape so that once the door sections have been assembled into the sectional door, the covering over both of these double-face adhesive tapes is removed and the sectional door is closed to bring these two adhesive strips together. Advantageously, the placement of two strips of double-face adhesive tapes means that the mounting of the L-shaped shield can be accomplished in inclement weather, under dusty conditions, or the like since each strip of adhesive is protected from contamination until the final assembly step.

The vertical leg of the L-shaped shield is then released from the upper door section. In this manner the L-shaped shield is securely fastened to the top edge of the lower door section in a position so that the vertical leg at all times shields the gap between the adjacent edges of the upper door section and the lower door section. This is especially important in that it prevents fingers from being either intentionally or inadvertently inserted between these two sections as the garage door is lowered.

The inner shield is installed after the sectional door has been assembled. This is accomplished by simply exposing an adhesive surface along one edge of the plastic strip and aligning this adhesive surface with the bottom edge of the upper door section prior to pressing the plastic strip into adhesive contact with the same. In this manner it is a simple procedure for an installer to install a sectional door and, prior to completion of the installation, provide the sectional door with the novel shield apparatus and method of this invention to thereby shield the door against persons becoming injured as the door is closed.

DETAILED DESCRIPTION

Figure 2:
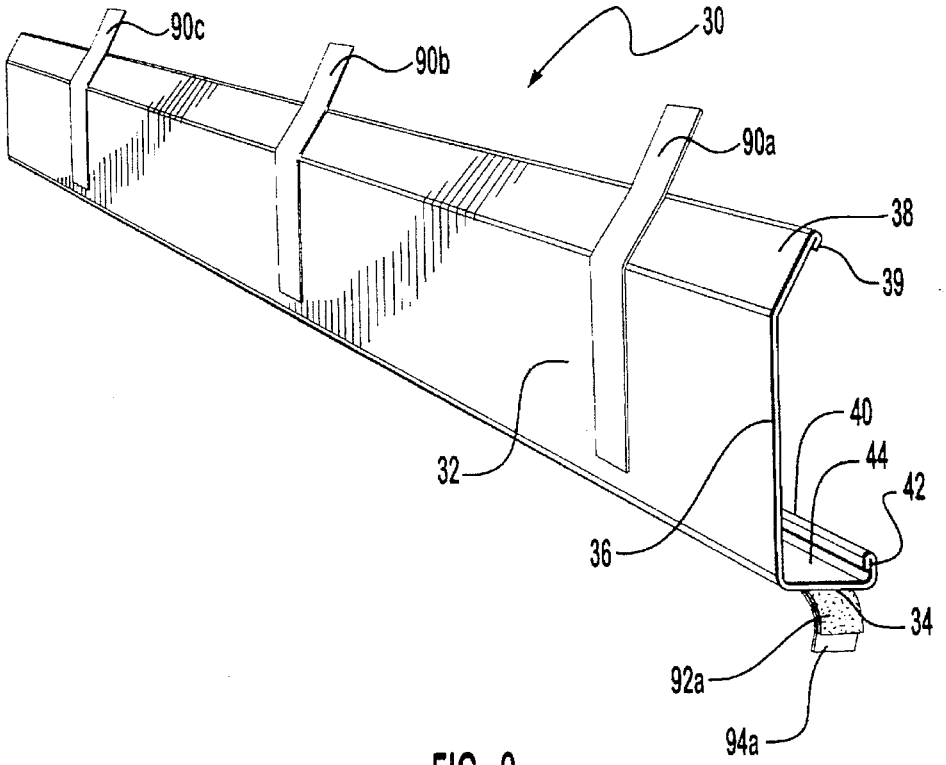
FIG. 2 is an enlarged, perspective view of a preferred embodiment of the novel shield apparatus of this invention and showing a first adhesive mounting means.

Referring now to FIG. 2, the novel shield apparatus of this invention is shown generally at 30 and includes a strip of resilient sheet material 32 formed into a generally L-shaped cross section having a horizontally oriented foot portion 34 and a vertically oriented leg portion 36. The upper edge of leg portion 36 is bent inwardly into a closure 38 having a single hem 39 formed along the interior edge thereof. Foot portion 34 includes an upwardly formed toe portion 40 with a single hem 42 formed thereon. The combination of toe portion 40 and single hem 42 creates a water channel 44 along the upper surface of foot portion 34, the function of which will be discussed more fully hereinafter. Shield apparatus 30 includes a first double-face adhesive strip **92*a* covered by a first cover 94*a***, the function of which will also be discussed more fully hereinafter.

Closure 38 is provided with an angular offset which angles it toward the sectional door, sectional door 50 (FIG. 4), where single hem 39 is held inside a transverse channel 58 therein. This feature more effectively blends shield apparatus 30 or, more specifically, closure 38 within the overall visual appearance of sectional door 50. The angular offset of closure 38 also increases the effective distance a person must extend his/her fingers in order to place those fingers into the gap 70 (FIG. 4) shielded by shield apparatus 30.

Figure 4:
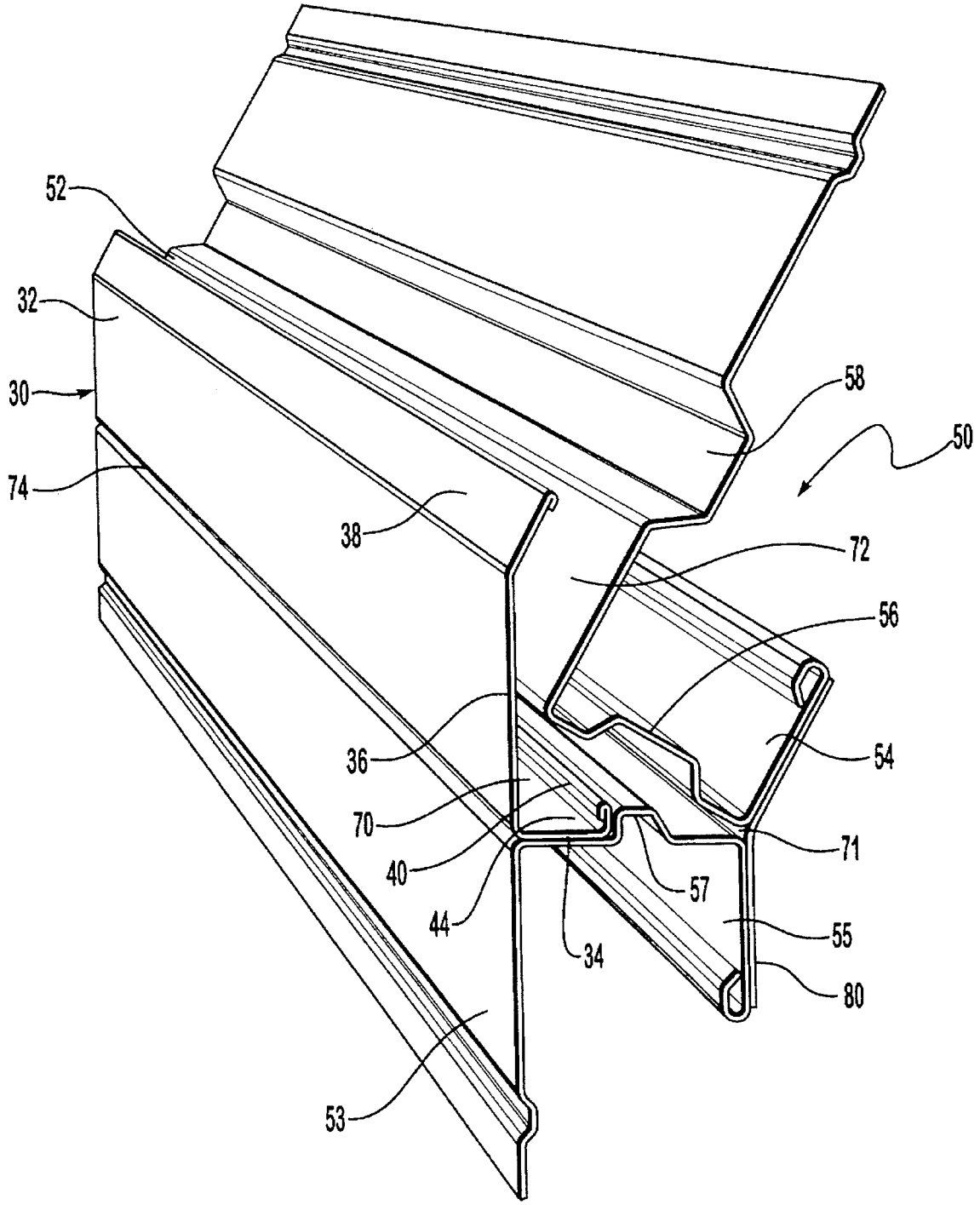
FIG. 4 is a fragmentary perspective view of the shield apparatus of FIG. 2 shown mounted to an upper edge of a bottom door section to shield the gap between the two, adjacent door sections.

Referring now also to FIG. 4, the novel shield apparatus 30 of this invention is shown mounted to a sectional door shown generally at 50. Sectional door 50 includes an upper door section 52 and a lower door section 53. Sectional door 50 is essentially identical to sectional door 10 (FIG. 1, Prior Art) except for the tongue portion, tongue 57, of lower door section 53. In particular, upper door section 52 includes a bottom edge 54 having a groove 56 formed in the bottom face thereof. Correspondingly, lower door section 53 includes a top edge 55 having tongue 57 formed therein. However, tongue 57 is configured as a partial tongue to accommodate the placement of foot 34 against top edge 55 leaving sufficient room for toe 40 to be received in groove 56.

Figure 5:
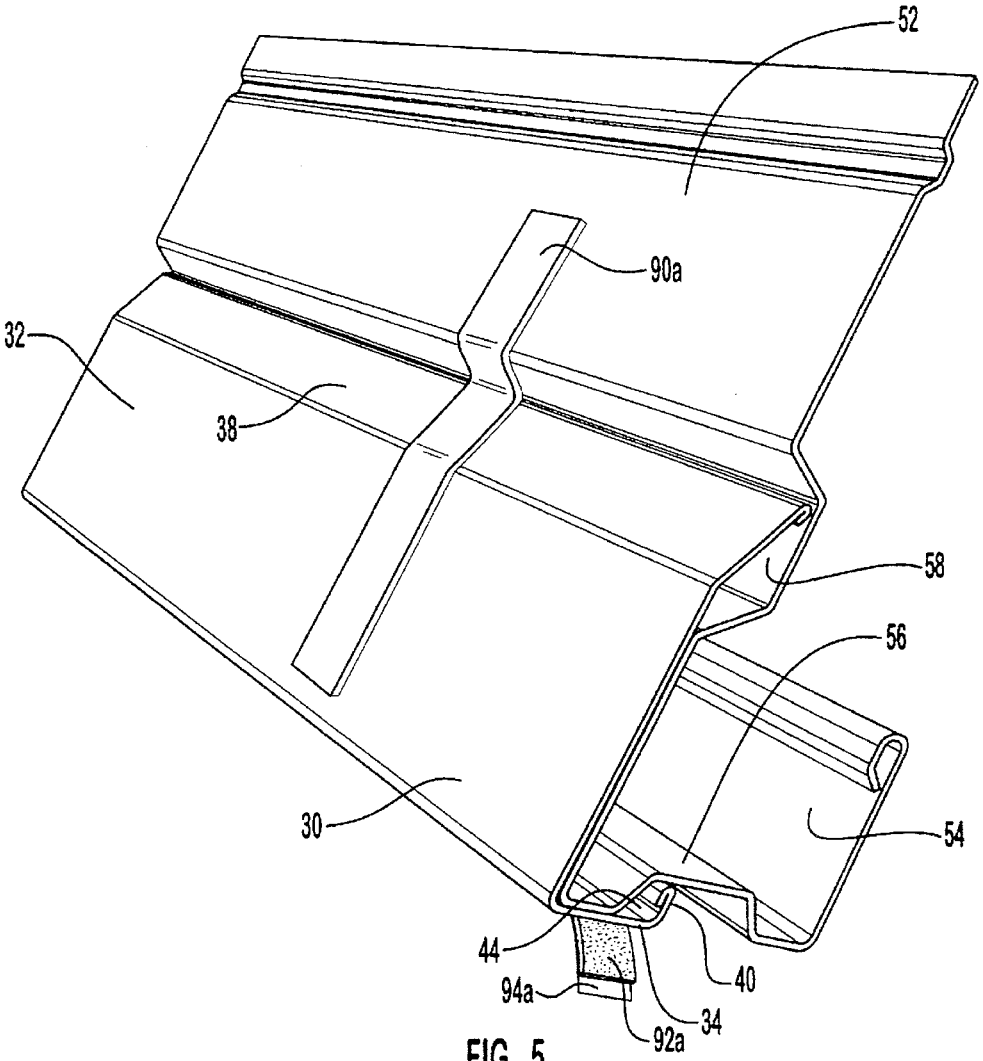
FIG. 5 is a fragmentary, perspective view of the shield apparatus of FIG. 4 shown mounted to the face of the bottom edge of the upper door section for shipping.
Figure 6:
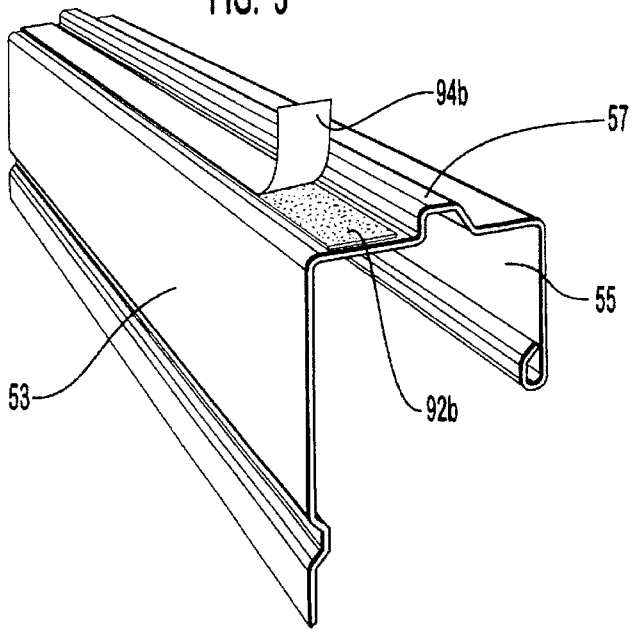
FIG. 6 is a fragmentary, perspective view of the top edge of the lower door section showing a second adhesive mounting means.

At this juncture, and with reference also to FIG. 5, a further feature of shield apparatus 30 is that for shipping purposes shield apparatus 30 is operable to being releasably secured to bottom edge 54 so that leg portion 36 and closure 38 are held snugly against the face of upper door section 52. This releasable securement of shield apparatus 30 to upper door section 52 for shipping purposes is accomplished by applying strips of shipping tapes **90*a*–90*c* transversely across shield apparatus 30 and adhering the same to the face of upper door section 52. This procedure holds toe 40 in groove 56 and thereby protects shield apparatus 30 from becoming bent or otherwise damaged since it essentially conforms to the external profile of bottom edge 54**.

Securement of shield apparatus 30 to top edge 55 is accomplished using a novel, pair of double-face tapes. First double-face tape 92*a* is applied to the under surface of water channel 44 and protected by a first cover 94*a*. A second double-face tape 92*b* is mounted to the top surface of top edge 55 of lower door section 53 and protected by a second cover 94*b*. This system of paired double-face tapes allows the installer (not shown) to simply hingedly mount upper door section 52 to lower door section 53 and then remove the protective cover 94*a* and 94*b* from first double-face tape 92*a* and second double-face tape 92*b*, respectively prior to bringing upper door section 52 into vertical alignment with lower door section 53 thereby causing the underlying double-face tapes 92*a* and 92*b* to adhesively adhere to each other and thereby securely mount foot 34 to top edge 55. Prior to lifting upper door section 52 shipping tapes 90*a*–90*c* are removed from shield apparatus 30 thereby freeing shield apparatus 30 from upper door section 52.

With shield apparatus 30 mounted to top edge 55 it is now in a blocking position across the gap 70 that inherently forms when the plane of upper door section 52 is angularly offset from the plane of lower door section 53. This shielding action occurs since vertical leg 36 is now coplanar with the face of lower door section 53 and in a shielding position across gap 70. Further, the inwardly angled orientation of closure 38 further shields gap 70 against either the inadvertent or deliberate intrusion of fingers (not shown) into gap 70. In the event a person does grasp closure 38 and places his/her fingers into the rapidly closing space between closure 38 and the face of upper door section 52, the inherent resiliency of sheet material 32 prevents injury to the fingers.

When in the closed position and with the plane of upper door section 52 residing coplanar with the plane of lower door section 53, closure 38 is nested in an underlying channel 58 formed across the face of upper door section 52. This nesting relationship imparts a pleasing visual appearance to sectional door 50 while at the same time reduces substantially the volume of any water that might seep behind shield apparatus 30. The visual appearance of sectional door 50 is also enhanced by the presence of shield apparatus 30 since the only visible indication of the joint between upper door section 52 and lower door section 53 is a joint line 74 where vertical leg 36 abuts the corresponding corner of top edge 55. Since joint line 74 is permanent, it is not affected by any minor changes in the overall alignment of upper door section 52 with lower door section 53 by reason of hinge wear, etc.

Figure 3:
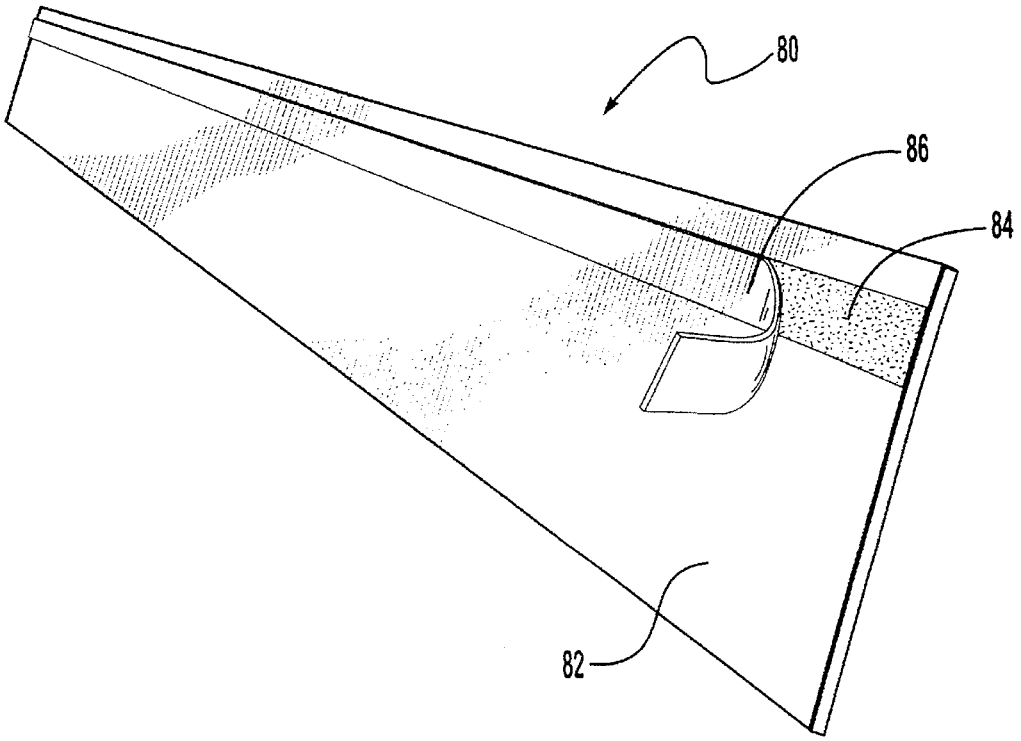
FIG. 3 is a perspective view of the inner shield portion of the novel shield apparatus of this invention.

Referring now to FIG. 3, the interior shield portion of the novel shield apparatus and method of this invention is shown generally at 80 and includes an elongated sheet resilient plastic 82 having an adhesive strip 84 along one edge thereof. Adhesive strip 84 is temporarily covered by a removable cover 86. Adhesive strip 84 is placed only along one edge of interior shield 80 since only that edge is secured to the interior of sectional door 50. Specifically, removable cover 86 is removed from adhesive 84 and interior shield 80 is placed into alignment with the inner face of bottom edge 54 prior to being adhesively secured thereto by adhesive 84. The free edge of interior shield 80 rests against the inner face of top edge 55 and is freely movable with respect thereto as sectional door 50 is raised and lowered. Specifically, as upper door section 52 is raised and is rotated from the vertical toward the horizontal, or while being lowered and is rotated from the horizontal toward the vertical, the plane of upper door section 52 is angularly offset from the plane of lower door section 53. However, adhesive strip 84 securely holds interior shield 80 against the inner face of bottom edge 53 thereby causing interior shield 80 to be bent inwardly relative to the inner face of top edge 55. The placement of the respective hinges (not shown) between upper door section and lower door section 53 causes interior shield 80 to slidingly cooperate with the inner face of top edge 55 thereby providing continuous shielding action across interior gap 71.

The Method

The novel method of my invention includes obtaining a strip of resilient sheet material 32 having a length corresponding to the overall width of sectional door 50 and forming sheet material 32 into shield apparatus 30. Specifically, shield apparatus 30 is created by being formed along its length into a generally L-shaped configuration thereby producing vertical leg 36 along with closure 38 and foot 34. Water channel 44 is created in foot 34 by upwardly bending the end of foot 34 into toe 40. Single hems 39 and 42 are formed along each edge of resilient sheet material 32 to eliminate any sharp edges that would otherwise be exposed. With shield apparatus 30 formed into the foregoing L-shaped configuration, it is ready for either attachment to top edge 55 to provide its shielding action to sectional door 50 or to be releasably affixed to bottom edge 54 for shipping purposes.

Shield apparatus 30 is easily shipped by being releasably secured to bottom edge 54 with toe 40 nesting in the recess of groove 56 and closure 38 nesting in transverse groove 58. Shield apparatus 30 is also held in this shipping relationship during the initial assembly of sectional door 50. Assembly of sectional door 50 is accomplished by hingedly joining upper section 52 to lower section 53 by mounting a plurality of hinges along in interior faces of the abutting edges of bottom edge 54 and top edge 55. Sectional door 50 is then raised until gap 70 is formed thereby exposing the bottom surface of water channel 44. First double-face tape 92*a* has previously been applied to the bottom surface of water channel 44 along with second double-face tape 92*b* which has been affixed to the upper face of top edge 55. First cover 94*a* and second cover 94*b* are removed so that simply lowering sectional door 50 closes gap 70 and adhesively secures shield apparatus 30 to top edge 55. Shipping tape 90*a*–90*c* is then removed and shield apparatus 30 is thus released from door section 52. Shield apparatus 30 is now operable to shield gap 70 against the intrusion of fingers therein. Specifically, as sectional door 50 is lowered gap 70 is concealed behind shield apparatus 30 thereby preventing fingers from being inserted into gap 70. Even if a person does insert fingers into space 72 between upper door section 52 and closure 38 by grasping closure 38, the resiliency of sheet material 32 prevents injury to the figures as space 72 diminishes. Interiorly, interior shield 80 is secured to the inside face of bottom edge 54 so as to depend downwardly across interior gap 71 and into sliding relationship against the inside face of top edge 55. This blocking action prevents fingers from being inserted into interior gap 71.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A joint shield for shielding the gap formed between an upper edge of a lower door section of a sectional door and a lower edge of an upper door section of the sectional door as the sectional door traverses between the raised, open position and the lowered, closed position, the upper door section and the lower door section being hingedly joined in an edge-to-edge relationship, the improvement comprising:

an outer joint shield comprising a strip of material having a length and a width, said strip being formed into a generally L-shaped configuration along said length, said L-shaped configuration having a horizontal foot portion and a vertical leg portion, said foot portion being configured to being mounted to the upper edge of the lower door section, said leg portion extending upwardly in shielding relationship across the gap between the upper edge of the lower door section and the lower edge of the adjoining upper door section, said outer joint shield including first attachment means for releasably securing said outer joint shield the lower edge of to the upper door section during shipment and a second attachment means for securing said outer joint shield to the upper edge of the lower door section after assembly of the sectional door, said first attachment means comprising a masking tape for releasably securing of said vertical leg to said upper door section.

2. A joint shield for shielding the gap formed between an upper edge of a lower door section of a sectional door and a lower edge of an upper door section of the sectional door as the sectional door traverses between the raised, open position and the lowered, closed position, the upper door section and the lower door section being hingedly joined in an edge-to-edge relationship, the improvement comprising:

an outer joint shield comprising a strip of material having a length and a width, said strip being formed into a generally L-shaped configuration along said length, said L-shaped configuration having a horizontal foot portion and a vertical leg portion, said foot portion being configured to being mounted to the upper edge of the lower door section, said leg portion extending upwardly in shielding relationship across the gap between the upper edge of the lower door section and the lower edge of the adjoining upper door section, said outer joint shield including first attachment means for releasably securing said outer joint shield the lower edge of to the upper door section during shipment and a second attachment means for securing said outer joint shield to the upper edge of the lower door section after assembly of the sectional door, said second attachment means comprising a pair of strips of adhesive, each of said strips of adhesive being protected by a releasable covering.

3. A joint shield for a sectional door, the sectional door having at least two door sections hingedly joined together in an edge-to-edge relationship, the two door sections being a lower door section and an upper door section, the sectional door having an outside face and an inside face and traversing between a raised, overhead position and a vertical, closed position with a gap forming at the joint between the lower door section and the upper door section as the sectional door traverses between the raised, overhead position and the vertical, closed position, the improvement comprising:

a joint shield for shielding the gap against the insertion of a finger in the gap during the traverse of the sectional door, said joint shield including an outer joint shield comprising a first strip of a first resilient material having a first length with a first end and a second end and a first width, said first strip being formed across said first width with a generally L-shaped profile having a foot and a vertical leg, said foot being mounted to an upper edge of the lower door section with said vertical leg extending upwardly on the outside face of the sectional door to span across the gap between the lower door section and the upper door section as the sectional door traverses between the raised, overhead position and the vertical, closed position, said outer joint shield including shipping means for shipping said outer joint shield, said shipping means including releasable tape means for releasably mounting said outer joint shield to the bottom edge of the upper door section.

4. The joint shield defined in claim 3 wherein said outer joint shield includes adhesive means for mounting said foot to the top edge of the lower door section thereby placing said vertical leg in blocking relationship across the gap between the upper door section and the lower door section.

5. A joint shield for a sectional door, the sectional door having at least two door sections hingedly joined together in an edge-to-edge relationship, the two door sections being a lower door section and an upper door section, the sectional door having an outside face and an inside face and traversing between a raised, overhead position and a vertical, closed position with a gap forming at the joint between the lower door section and the upper door section as the sectional door traverses between the raised, overhead position and the vertical, closed position, the improvement comprising:

a joint shield for shielding the gap against the insertion of a finger in the gap during the traverse of the sectional door, said joint shield including an outer joint shield comprising a first strip of a first resilient material having a first length with a first end and a second end and a first width, said first strip being formed across said first width with a generally L-shaped profile having a foot and a vertical leg, said foot being mounted to an upper edge of the lower door section with said vertical leg extending upwardly on the outside face of the sectional door to span across the gap between the lower door section and the upper door section as the sectional door traverses between the raised, overhead position and the vertical, closed position, said inner joint shield including adhesive means for mounting said inner joint shield to the inside face of the upper door section.

* * * * *